US010456810B2

(12) United States Patent
Riley

(10) Patent No.: US 10,456,810 B2
(45) Date of Patent: Oct. 29, 2019

(54) INFLATION-ACTIVATED SEPARATOR SCREEN

(71) Applicant: M-I LLC, Houston, TX (US)

(72) Inventor: David Riley, Florence, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 16/108,927

(22) Filed: Aug. 22, 2018

(65) Prior Publication Data

US 2019/0126319 A1 May 2, 2019

Related U.S. Application Data

(60) Provisional application No. 62/578,269, filed on Oct. 27, 2017.

(51) Int. Cl.

| | |
|---|---|
| ***B07B 1/48*** | (2006.01) |
| ***B07B 1/28*** | (2006.01) |
| ***E21B 21/06*** | (2006.01) |
| ***B07B 1/46*** | (2006.01) |
| ***B07B 1/42*** | (2006.01) |

(52) U.S. Cl.

CPC ..... *B07B 1/485* (2013.01); *B07B 1/282* (2013.01); *B07B 1/42* (2013.01); *B07B 1/46* (2013.01); *B07B 1/4609* (2013.01); *B07B 1/4663* (2013.01); *B07B 1/48* (2013.01); *E21B 21/063* (2013.01); *B07B 2201/02* (2013.01)

(58) Field of Classification Search

CPC ..... B07B 1/42; B07B 1/485; B07B 1/4609; B07B 1/282; E21B 21/063

See application file for complete search history.

(56) References Cited

U.S. PATENT DOCUMENTS

| | | | | |
|---|---|---|---|---|
| 3,176,843 | A * | 4/1965 | Hoskins | B07B 1/48 101/127.1 |
| 3,557,953 | A * | 1/1971 | Hubach | B07B 1/49 101/127.1 |
| 3,655,045 | A * | 4/1972 | McAllister, Jr. | B07B 1/50 209/379 |
| 5,265,730 | A * | 11/1993 | Norris | B07B 1/42 198/770 |
| 6,938,779 | B2 * | 9/2005 | Burnett | B01D 33/0376 209/405 |
| 2004/0074816 | A1 | 4/2004 | Seyffert et al. | |

(Continued)

FOREIGN PATENT DOCUMENTS

WO 2008/042856 A1 4/2008

OTHER PUBLICATIONS

International Search Report and Written Opinion for the equivalent International patent application PCT/US2018/055338 dated Apr. 2, 2019.

*Primary Examiner* — Joseph C Rodriguez
*Assistant Examiner* — Kalyanavenkateshware Kumar
(74) *Attorney, Agent, or Firm* — Jeffrey D. Frantz

(57) ABSTRACT

Vibratory separator screens separate solids and/or fluids, methods form said screens and vibratory screen apparatuses utilize said screens. The vibratory separator screens, methods and apparatuses have a mesh portion having a first side of the mesh portion and an opposite second side of the mesh portion, a first hem crimp affixed to the first side of the mesh portion, and a second hem crimp affixed to the second side of the mesh portion.

16 Claims, 4 Drawing Sheets

(56) References Cited

U.S. PATENT DOCUMENTS

| | | | | |
|---|---|---|---|---|
| 2004/0074819 | A1* | 4/2004 | Burnett | B01D 33/0376 209/405 |
| 2004/0238434 | A1* | 12/2004 | Fisher | B01D 33/0376 210/359 |
| 2004/0245155 | A1* | 12/2004 | Strong | B01D 33/0376 209/405 |
| 2005/0199532 | A1* | 9/2005 | Schulte | B01D 33/033 209/405 |
| 2006/0163121 | A1* | 7/2006 | Fisher | B01D 33/0376 209/399 |
| 2010/0270216 | A1 | 10/2010 | Burnett et al. | |
| 2013/0105412 | A1 | 5/2013 | Burnett et al. | |
| 2014/0262975 | A1* | 9/2014 | McGrath, Jr. | B07B 1/4663 209/240 |
| 2015/0048037 | A1 | 2/2015 | Frazier et al. | |

* cited by examiner

INFLATION-ACTIVATED SEPARATOR SCREEN

CROSS-REFERENCE TO RELATED APPLICATION

Priority is claimed from U.S. Provisional Application No. 62/578,269 filed Oct. 27, 2017 and incorporated by reference as if fully set forth herein.

BACKGROUND OF THE DISCLOSURE

Industrial separators use screens to separate solids and/or fluids. For example, separators are used in the mining industry to separate solids from fluids, such as to extract ore and/or metal during mining processes. Separators are also used in the oil and gas industry during well drilling operations to separate drill cuttings and other solids from drilling fluid.

One type of separator is a vibratory screen apparatus for sifting material. One type of vibratory screen apparatus utilizes a hook strip screen formed of a mesh having openings sized to permit smaller particles (below a predetermined size) to fall through the screen into a basket, thereby separating the smaller particles from larger particles. Opposing ends of the hook strip screen have elements forming strip-shaped hooks attached to the mesh. The hooks hook around tension rails mounted on opposing sides of the vibratory screen apparatus. Tension bolts are then tightened to push the hook strips apart, thereby pulling the mesh screen taut across the vibratory screen apparatus.

However, the hook strip type of separator is not ideal. For example, several bolts on each side of the machine are tightened or loosened to install or remove each screen. In larger machines, over one-hundred (100) bolts have to be torqued for screen service, causing excessive down time and increasing the risk of injury. Moreover, as the bolts are loosened, the rails tend to fall on the screen, making installation or removal difficult. Hook strips also have sharp metal edges that can cut the screen. A hook strip screen can also have poor sealing between the screen and the basket, such as where a metal-on-metal seal permits leakage, whereby unscreened material can pass through gaps between the screen and the basket and mix with already screened material.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure is directed to a screen separator having a pneumatic or hydraulic screen tensioning system. First, there may be no bolts for installing and/or tensioning the screen. That is, the screen is tensioned when an inflatable element inflates, causing the screen to be pushed upward, and causing ends of the screen to be moved outward, thus providing a taught screen. The action of inflating or deflating the screen may be done via operating a switch, and perhaps no tools. The design of hem crimps at opposing edges of the screen permits the screen to be captured within a screen edge cavity without impeding installation or removal. The shape of the hem crimps permits screen tensioning due to their geometry in cooperation with other components of the separator. The hem crimps efficiently capture the screen by crimping, and also protect the screen because they have no sharp edges exposed to the mesh screen. The rounded screen contact points may substantially increase screen life.

In embodiments, a vibratory screen apparatus is provided. The apparatus may have a support structure having a central opening, a basket disposed in the central opening of the support structure, opposing rails attached to opposing internal surfaces of the basket, an inflatable element disposed in a channel portion of a first rail of the opposing rails, a box disposed between the opposing rails, and a screen positionable over the box. The screen may have a mesh portion contactable by the box when the box is lifted via inflation of the inflatable element, and a first hem crimp affixed to a first side of the mesh portion and contained within a first screen edge cavity that is defined between the first rail, the inflatable element, and the box.

In other embodiments, a method of forming a screen is provided. The method may position a first edge of a mesh portion proximate a vertex of an angle formed between first portions of a first hem crimp, bend the first portions of the first hem crimp together to secure the first edge of the mesh portion therebetween said bent first portions of the first hem crimp and to form a first U-shaped bend of the first hem crimp, and bend the first U-shaped bend of the first hem crimp over and/or onto the first hem crimp itself to form a second U-shaped bend of the first hem crimp such that the first edge of the mesh portion is hemmed and/or crimped to the first hem crimp.

In other embodiments, a vibratory separator screen is provided. The screen may have a mesh portion having a first edge of the mesh portion and an opposite second edge of the mesh portion, and a first hem crimp secured to the first edge of the mesh portion, wherein the first hem crimp comprises a body having a width defined between a first end of the first hem crimp and an opposite second end of the first hem crimp, wherein the first hem crimp further comprises a hemming end portion at the first end extending from the body of the first hem crimp and a slanted end portion at the second end extending from the body of the first hem crimp, wherein the hemming end portion comprises a plurality of portions that are folded to form more than one U-shaped bend and at least a portion of the mesh portion is sandwiched between at least one selected from the plurality of portions of the hemming end portion and the more than one U-shaped bend of the hemming end portion at or near the first edge of the mesh portion.

In other embodiments, a vibratory separator screen is provided. The screen may have a mesh portion having a first side of the mesh portion and an opposite second side of the mesh portion, a first hem crimp affixed to the first side of the mesh portion such that the first side is sandwiched between hemming portions of the first hem crimp at or near a first edge of the mesh portion, and a second hem crimp affixed to the second side of the mesh portion such that the second side is sandwiched between hemming portions of the second hem crimp at or near a second edge of the mesh portion.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
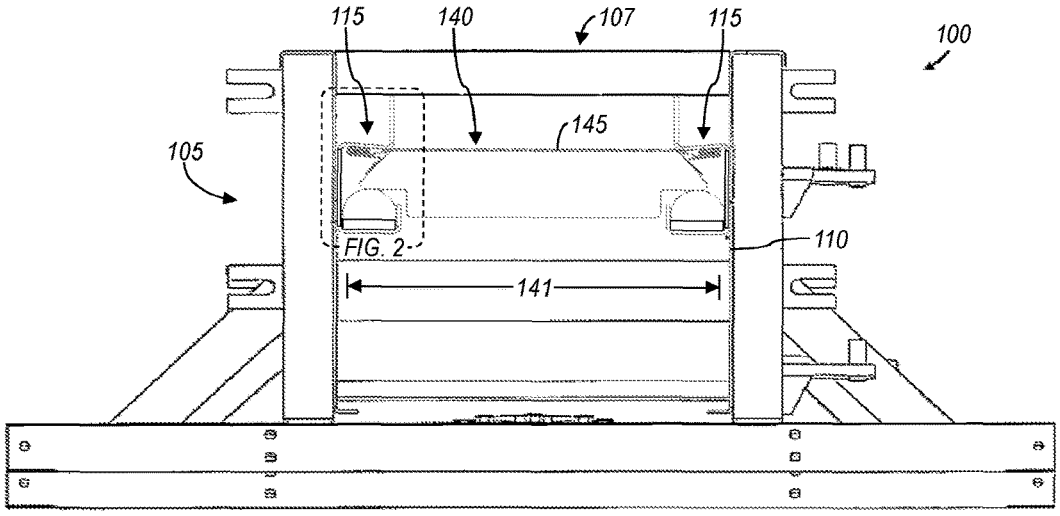
FIG. 1 is a schematic view of at least a portion of an example implementation of an apparatus according to one or more embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
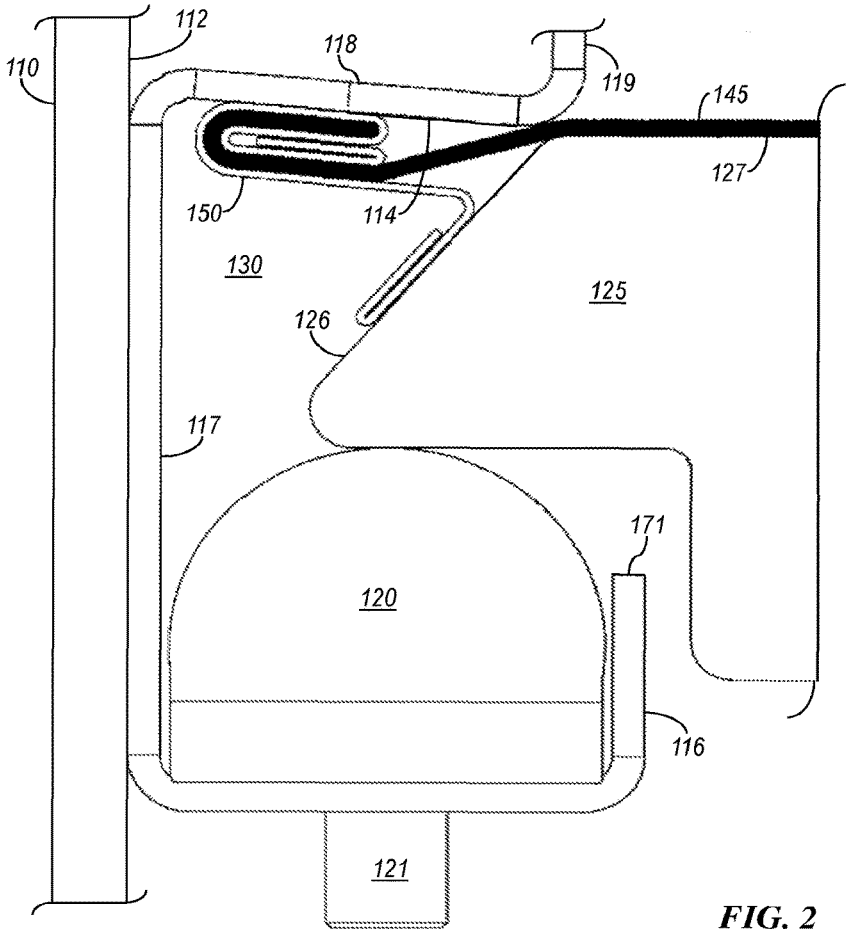
FIG. 2 is a schematic view of a portion of the apparatus shown in FIG. 1 in an embodiment of the present disclosure.

FIG. 1 is a schematic view of at least a portion of an example implementation of a vibratory screen apparatus 100 (hereinafter "apparatus 100"), also referred to herein as a separator 100, according to one or more embodiments of the present disclosure. FIG. 2 is an enlarged view of a portion of a basket 110 of the vibratory screen apparatus 100 shown in FIG. 1, and some components in the basket 110. The following description refers to FIGS. 1 and 2, collectively.

The apparatus 100 or the separator 100 includes a support structure 105 having a central opening 107 for receiving the basket 110. Rails 115 are attached to opposing inside surfaces 112 of the basket 110. Each rail 115 includes a channel 116 supporting an inflatable element 120, a middle portion 117 extending up from the channel 116 and attached to the inside wall 112 of the basket 110, a hem-reactor portion 118 extending inward from the middle portion 117, and perhaps an upper portion 119 extending upward from the hem-reactor portion 118. Opposing sides of a box 125 are each supported by one of the inflatable elements 120. The box 125 may be a ball box or other device for supporting a screen as will be appreciated by a person having ordinary skill in the art.

A screen 140 is positioned over the box 125. The screen 140 includes a central mesh portion 145 and hem crimps 150 affixed to opposing sides of the central mesh portion 145. On each side of the screen 140, the hem crimp 150 is contained in a screen edge cavity 130 defined between the inflatable element 120, the middle and hem-reactor portions 117, 118 of the rail 115, and an outer, slanted surface 126 of the box 125. The width 141 of the screen 140 keeps the hem crimp 150 on each side in contact with the slanted surface 126 of the box 125 and a bottom surface 114 of the hem-reactor portion 118 of the rail 115.

Figure 3:
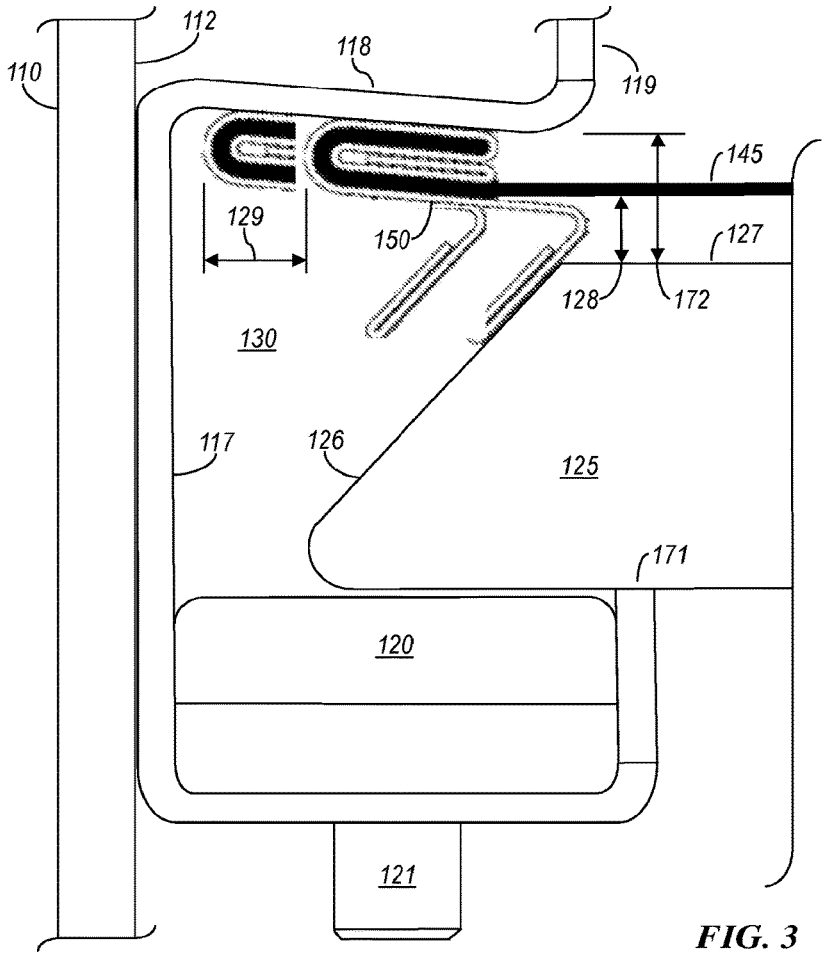
FIG. 3 is a schematic view of the portion of the apparatus shown in FIG. 2 in a different operational stage in an embodiment of the present disclosure.

In FIGS. 1 and 2, the inflatable elements 120 are inflated, thus urging an upper surface 127 of the box 125 into contact with the mesh portion 145 of the screen 140. FIG. 3 shows the same components as depicted in FIG. 2, but after the inflatable elements 120 have been deflated, thus lowering the box 125 such that a gap 128 exists between the screen 140 and the upper surface 127 of the box 125. If the hem crimps 150 are made from a sufficiently elastic material, like spring steel, the deflation of the inflatable elements 120 and the resulting lowering of the box 125 may also permit the hem crimps 150 to relax from a deflected position to (or toward) a relaxed (or at least less deflected) position. However, the hem crimps 150 may be made from a less elastic material, such as stainless steel, such that the hem crimps 150 do not deflect in response to inflation or deflation of the inflatable elements 120. In either implementation, deflating the inflatable elements 120 to lower the box 125 permits the hem crimps 150 to move inward along the bottom surface 114 of the hem-reactor portion 118 of the rail 115, whereby the tension in the screen 140 is decreased. Such movement of the hem crimp 150 may be through a distance 129 (relative to the previous position of the hem crimp 150 shown in FIGS. 1 and 2, shown in phantom in FIG. 3) in a direction being generally away from the respective inner surfaces 112 of the basket 110. In such position, the screen 140 may sag, so that just a central portion (if any) of the screen 140 remains in contact with the upper surface 127 of the box 125.

Figure 4:
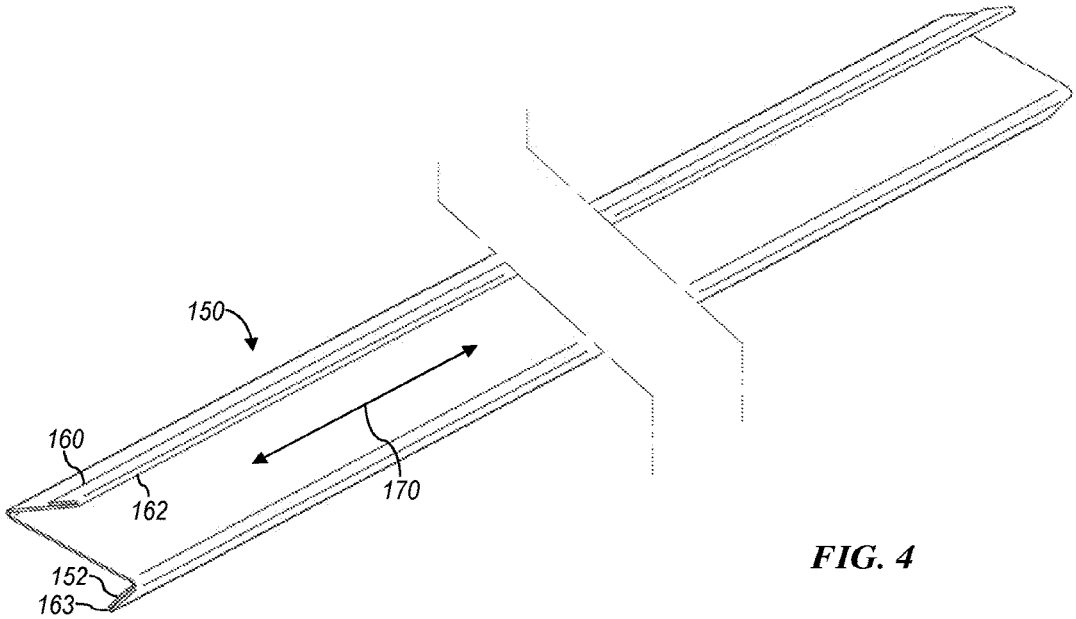
FIG. 4 is a perspective view of a component of the apparatus shown in FIGS. 1-3 in an embodiment of the present disclosure.
Figure 5:
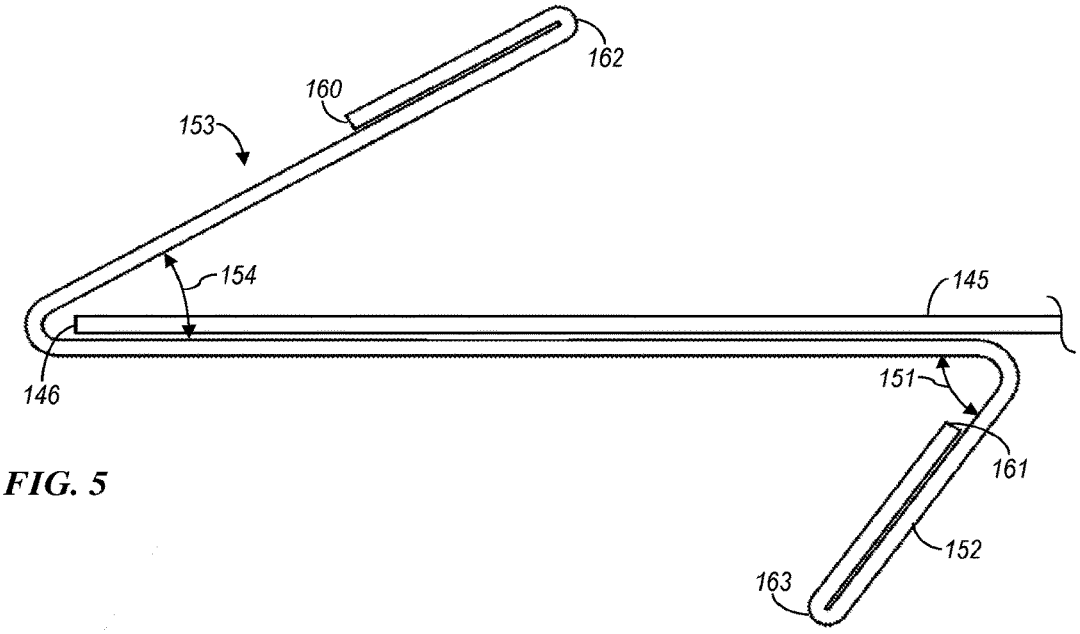
FIGS. 5-7 are end views of the component shown in FIG. 4 during a crimping process according to one or more embodiments of the present disclosure.

The screen 140 may have a single layer of mesh 145, or multiple layers of mesh bonded together. FIG. 4 is an isometric view of one of the hem crimps 150 prior to being used to hem the mesh portion 145. FIG. 5 is an end view of the hem crimp of FIG. 4 with the mesh 145 being positioned for the hemming/crimping process of attaching the hem crimp 150 to an edge 146 of the mesh 145.

Figure 6:
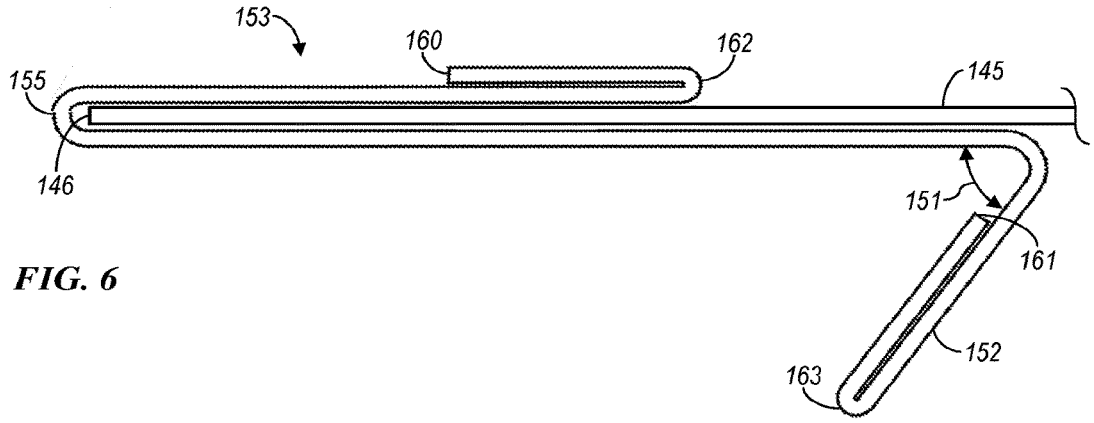
Figure 7:
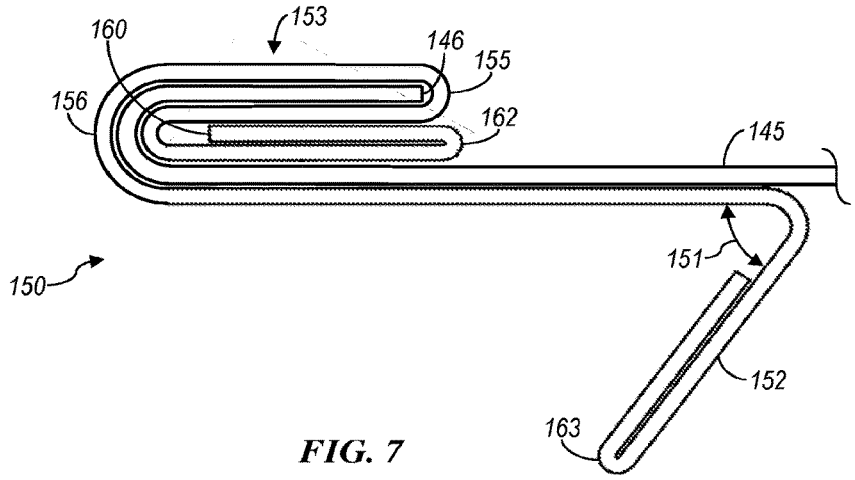

The hem crimp 150 is formed from metal sheet-stock by bending both ends 160, 161 over to about 180 degrees to form U-bends 162, 163, respectively. The U-bend 163 is then bent by an angle 151 by about 30-45 degrees (e.g., such as about 30, 35, 40, or 45 degrees) to form a slanted end portion 152 that slides along the slanted surface 126 of the box 125. A hemming end portion 153 is initially formed by bending the U-bend 162 by an angle 154 about 45-75 degrees (e.g., such as about 45, 50, 55, 60, 65, 70, or 75 degrees). The edge 146 of the mesh 145 is then positioned at or near the vertex of the angle 154, as shown in FIG. 5, and the hemming end portion 153 is then further bent so that the angle 154 is at or near zero degrees, as shown in FIG. 6. Thus, the mesh 145 becomes sandwiched between the metal portions that form the angle 154 and now form a U-bend 155 at or near the edge 146 of the mesh 145. The U-bend 155 is then folded over once more to crimp and/or otherwise secure the hem crimp 150 to the mesh 145, thus forming another U-bend 156, as shown in FIG. 7.

In this manner, none of the sharp edges of the hem crimp 150 touch the mesh 145. Instead, just flat or curved portions of the hem crimp 150 touch the mesh 145. Consequently, the mesh 145 is less susceptible to damage, at least relative to previous designs in which sharp edges of the means for fastening the mesh 145 touch the mesh 145, which can dig into and/or otherwise damage the mesh 145 over time.

Moreover, the depicted separator 100 has no bolts or other tedious means for intricately tensioning the screen 140 across the box 125. Instead, the mere inflation of the inflatable members 120 provides the intended tensioning of the screen 140, due to the cooperating nature of the hem crimps 150 with the hem-reactor portion 118 of the rail 115 and the slanted box surface 126. As the box 125 moves upward during inflation of the inflatable members 120, the hem-reactor portion 118 prevents similar upward movement of the hem crimps 150, such that the slanted end portion 152 of each hem crimp 150 and the corresponding slanted surface 126 of the box 125 cooperate to urge the hem crimps 150 away from each other, thereby tensioning the mesh 145.

The hem-reactor portions 118 of the rails 115, the hem crimps 150, and the slanted surfaces 126 of the box 125 may also be designed so that the hem crimps 150 cannot escape the screen edge cavity 130 other than by sliding the screen 140 longitudinally (e.g., into or out of the page in FIGS. 1-3, and thus the direction of the arrow 170 in FIG. 4). Thus, on each side of the apparatus 100 or the separator 100, even when the inflatable members 120 are fully deflated such that the box 125 rests on an upper end 171 of the channel portion 116 of the rail 115 (as depicted in FIG. 3), the gap 172 between the hem-reaction portion 118 of the rail 115 and the upper surface 127 of the box 125 is too small to permit passage of the hem crimp 150.

Inflation of the inflatable members 120 may be via one or more ports 121 and/or other means. The inflatable members 120 may be inflated via pressurized air, oxygen, oil, and/or other hydraulic or pneumatic fluids/gases.

The middle rail portions 117 may be secured to the interior wall 112 of the basket 110 by threaded fasteners (not shown). However, other fasteners (e.g., pins, clamps, and others), welding, brazing, soldering, adhesive, and/or other means may also or instead be utilized to attach the rails 115 to the basket 110.

The box 125 may be a crowned or other type of deck, a ball box, and/or other components. The ball box may contain balls and/or other objects (not shown) of various shapes and/or sizes, and that move during vibratory motion produced during operation of the apparatus 100 or the separator 100. The movement of the objects may cause impact with the screen 140 to impart movement of solids/fluids on the screen 140.

The mesh portion 145 of the screen 140 may be a single layer of mesh material. In other implementations, the mesh portion 145 of the screen 140 may comprise multiple layers of mesh material, which may be bonded together via fasteners, welding, brazing, soldering, adhesive, and/or other means. Each layer of mesh material may be formed from steel, other metals, and/or other materials. Different layers may be formed from different materials, or each layer may be formed from the same material.

When the inflatable element 120 has been inflated to raise the box 125 into contact with the screen 140, as depicted in FIGS. 1 and 2, the crimped end 153 of the hem crimp 150 stays in contact with the lower surface 114 of the hem-reactor portion 118 of the rail 115. This contact prevents materials on the screen 140 (the material being separated via operation of the separator 100) from leaking past the edges of the screen 140. In this position, the inward-most portion of the hem-reactor portion 118 may also be in contact with the screen 140, as also shown in FIGS. 1 and 2, which may also aid in preventing leakage, although in other implementations the hem-reactor portion 118 may not contact the screen 140.

Figure 8:
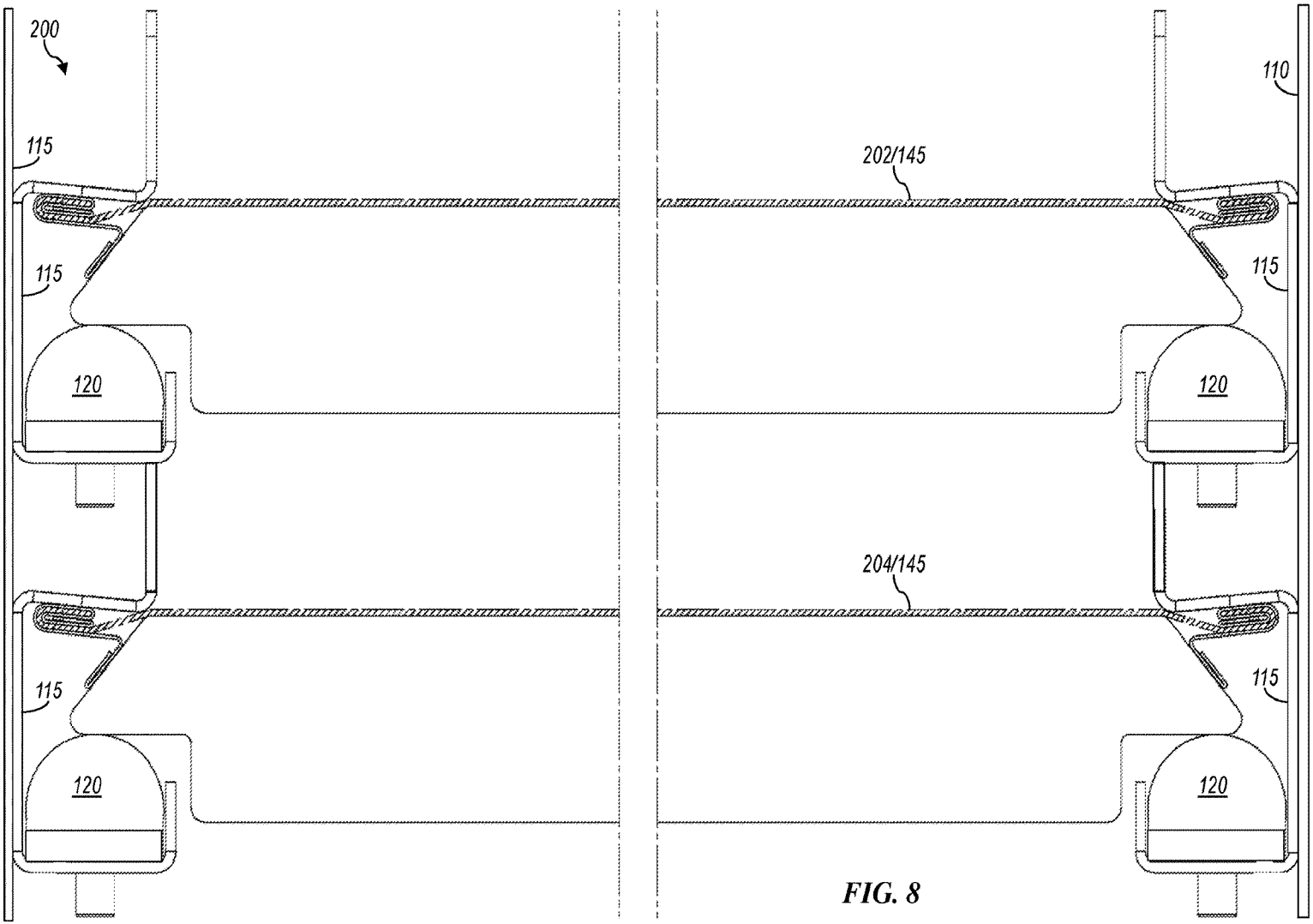
FIG. 8 is a schematic view of a portion of another example implementation of the apparatus shown in FIGS. 1-3 according to one or more embodiments of the present disclosure.

FIG. 8 is an end view of a portion of another implementation of the separator 100 shown in FIGS. 1-3, and designated in FIG. 8 via reference number 200. The separator 200 is substantially similar or the same as the apparatus 100 or the separator 100 shown in FIGS. 1-3, except that the separator 200 includes an upper screen 202 and a lower screen 204, each of which are substantially similar or the same as the screen 140 shown in FIGS. 1-3. The rails 115 of the upper and lower screens 202, 204 may be attached to each other via fasteners, welding, brazing, soldering, adhesive, and/or other means (not shown). However, the upper and lower screens 202, 204 may not be attached to each other, and may not even be in contact, such that their relative positioning may be achieved via their attachment to the basket 110. The mesh portions 145 of the upper and lower screens 202, 204 may be for separating the same size particles, or one of the upper and lower screens 202, 204 (e.g., the lower screen 204) may be for separating smaller particles than the other screen. The inflatable elements 120 of the upper and lower screens 202, 204 may be operable independently (at different times) or collectively (and thus simultaneously).

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

What is claimed is:

1. A method of forming a screen, the method comprising:

bending a first end of a first hem crimp over an adjacent first portion of the first hem crimp to form a first U-shaped bend;

bending the first U-shaped bend by an angle to form a hemming end portion;

positioning a first edge of a mesh portion proximate a vertex of the angle;

bending the hemming end portion over an adjacent second portion of the first hem crimp to form a second U-shaped bend and to secure the first edge of the mesh portion therebetween the hemming end portion and the adjacent second portion of the first hem crimp; and bending the second U-shaped bend over and onto the first U-shaped bend to form a third U-shaped bend, such that the first edge of the mesh portion is at least one of hemmed and crimped to the first hem crimp.

2. The method according to claim 1, further comprising:

overlapping the adjacent first portion and the adjacent second portion of the first hem crimp onto themselves between the first edge of the mesh portion and a central portion of the mesh portion, wherein the first edge of the mesh portion is connected to the central portion of the mesh portion.

3. The method according to claim 1, further comprising:
securing a second edge of the mesh portion to a second hem crimp, wherein the second edge of the mesh portion is located opposite to the first edge of the mesh portion.

4. The method according to claim 3, further comprising:
hemming or crimping the second edge to the second hem crimp via at least one U-shaped bend of the second hem crimp.

5. The method according to claim 1, further comprising:
providing a fourth U-shaped bend on a side of the first hem crimp that is opposite with respect to the second U-shaped bend.

6. The method according to claim 5, further comprising:
bending the fourth U-shaped bend by an angle of about 30 to 40 degrees to form a slanted end portion of the first hem crimp.

7. A vibratory separator screen comprising:
a mesh portion having a first edge of the mesh portion and an opposite second edge of the mesh portion; and
a first hem crimp secured to the first edge of the mesh portion, wherein the first hem crimp comprises a body connecting a first end of the first hem crimp to an opposite second end of the first hem crimp, wherein the first end of the first hem crimp comprises a first U-shaped bend, and the first hem crimp further comprises a hemming end portion extending from the body to the first U-shaped bend, a slanted end portion at the second end of the first hem crimp extending from the body, a second U-shaped bend near the first edge of the mesh portion and the hemming end portion, and a third U-shaped bend connecting the second U-shaped bend to the body, such that the first U-shaped bend is provided between the second U-shaped bend and the body, and the first hem crimp is crimped to the mesh portion.

8. The screen according to claim 7, wherein the slanted end portion extends opposite with respect to the hemming end portion and is angled inwardly towards the first end of the first hem crimp.

9. The screen according to claim 7, wherein the slanted end portion comprises a fourth U-shape bend located opposite with respect to the body of the first hem crimp.

10. The screen according to claim 7, wherein the slanted end portion is bent at an angle of about 30 to 45 degrees with respect to the body of the first hem crimp.

11. The screen according to claim 10, further comprising:
a second hem crimp affixed to the second edge of the mesh portion, wherein the second hem crimp comprises more than one U-shaped bend, and the mesh portion is crimped to the second hem crimp via the more than one U-shaped bend of the second hem crimp.

12. A vibratory separator screen comprising:
a mesh portion having a first surface connecting a first edge of the mesh portion to an opposite second edge of the mesh portion; and
a first hem crimp affixed to the first edge of the mesh portion and comprising a plurality of first U-shaped bends, such that the plurality of first U-shaped bends crimps the first hem crimp to the first edge of the mesh portion, wherein a second U-shaped bend is formed on a side of the first hem crimp opposite with respect to the plurality of first U-shaped bends and angled inwardly with respect to the plurality of first U-shaped bends.

13. The screen according to claim 12, wherein the first hem crimp has a slanted end portion that is bent at an angle with respect to the plurality of first U-shaped bends, and the slanted end portion comprises the second U-shaped bend.

14. The screen according to claim 13, wherein the angle is about 30 to 45 degrees.

15. The screen according to claim 13, wherein the mesh portion has a central mesh portion between the first edge and the second edge of the mesh portion, and a portion of the central mesh portion is located between the slanted end portion of the first hem crimp and the first edge of the mesh portion.

16. The screen according to claim 12, wherein two first U-shaped bends of the plurality of first U-shaped bends crimp the first hem crimp to the mesh portion.

* * * * *